US005936505A

United States Patent [19]

Yu

[11] Patent Number: 5,936,505

[45] Date of Patent: Aug. 10, 1999

[54] CIRCUIT BREAKER

[75] Inventor: Lung-Shou Yu, Taipei Hsien, Taiwan

[73] Assignee: Hwa Won Electric Industrial, Co., Ltd., Taipei Hsien, Taiwan

[21] Appl. No.: 09/181,551

[22] Filed: Oct. 29, 1998

[51] Int. Cl.[6] ..... H01H 71/16; H01H 61/00; H01H 31/74

[52] U.S. Cl. ..... 337/66; 337/59; 337/37; 337/345; 200/310; 200/313

[58] Field of Search ..... 337/56, 66, 76, 337/67, 79, 59, 36, 37, 85, 333, 343, 345, 362, 367; 200/310, 313

[56] References Cited

U.S. PATENT DOCUMENTS 4,363,016 12/1982 Unger ..... 337/56
5,079,530 1/1992 Tsuchiyama ..... 335/17
5,453,725 9/1995 You et al. ..... 337/68
5,539,371 7/1996 Yu ..... 337/66
5,694,106 12/1997 Wang ..... 337/79

*Primary Examiner*—Leo P. Picard
*Assistant Examiner*—Anatoly Vortman
*Attorney, Agent, or Firm*—Rosenberg, Klein & Bilker

[57] ABSTRACT

A circuit breaker has a body providing a lever pivotally mounted on the upper end thereof. Two terminals are disposed within the body, wherein the first terminal forms a bimetal thereon. The terminals are electrically connected with each other in a normal state. A linkage is mounted on an end of the lever, which forms an isolated member on the lower end of the linkage. Pressing the lever, the isolated member of the linkage will moved upwards to separate the two terminals. When the lever is held by some heavy substances, the bimetal can be deformed to disconnect with the second terminal in over-current for cutting out the circuit.

6 Claims, 4 Drawing Sheets

CIRCUIT BREAKER

BACKGROUND OF THE INVENTION

1. Field of the Invention

The present invention is related to a circuit breaker, and more particularly to a circuit breaker, which can cut out the circuit with its lever being held when the circuit is under over-current.

2. Description of Related Art

When a circuit is under over-current, a circuit breaker is used to cut out the circuit for protecting the electrical equipment.

As shown on FIGS. 6 and 7, a conventional circuit breaker has a housing (80). A lever (81) is pivotally mounted on the upper end of the housing (80). A first terminal (82) and a second terminal (83) are disposed in the lower portion of the housing (80). The first terminal (82) integrally forms a bimetal (84) on the distal end within the housing (80). The bimetal (84) and the second terminal (83) respectively form two opposite platinum nodes (830), (840) in their distal ends. The bimetal (84) is connected with a linkage (85). The other end of the linkage (85) is connected to the lever (81). A U-like elastic leaf (86) is provided between the linkage (85) and the side wall of the housing (80).

FIG. 7 shows a use state of the circuit breaker. The lever (81) is pressed to drive the linkage (85) and the bimetal (84) downwards. Therefore, the platinum node (840) of the bimetal (84) is in contact with the platinum node (830) of the second terminal (83), so the circuit is conductive.

When the circuit is under over-current, the bimetal (84) is deformed as its temperature raised. Thereby, the bimetal (84), cooperated with the U-like elastic leaf (86), will be disconnected with the second terminal (83). The circuit is then cut out.

However, if the lever (81) is held by some heavy substance covering thereon, the bimetal (84) will not disconnect with the second terminal (83). In this case, the circuit breaker is failure. Then, the over-current will destroy the electrical equipment and cause a fire or other accidents.

A circuit breaker in accordance with the present invention tends to mitigate and/or obviate the aforementioned problem.

SUMMARY OF THE INVENTION

The major object of the present invention is to provide a circuit breaker which can cut out the circuit with its lever being held by some heavy substances when the circuit is under overload.

Other objects, advantages and novel features of the invention will become more apparent from the following detailed description when taken in conjunction with the accompanying drawings.

DETAILED DESCRIPTION OF THE PREFERRED EMBODIMENT

Figure 1:
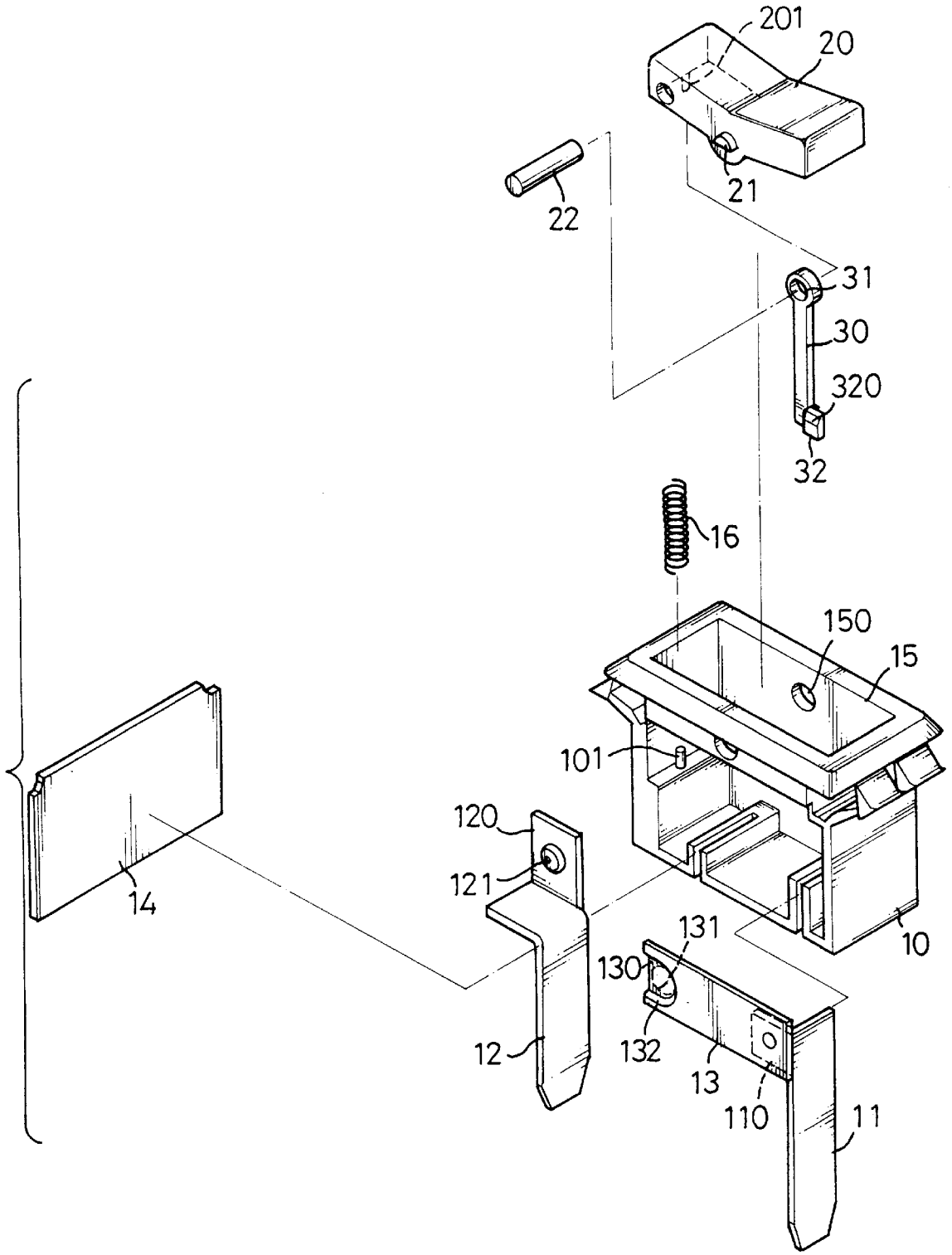
FIG. 1 is an exploded view of a circuit breaker according to the present invention.

Referring to FIG. 1, the circuit breaker comprises a body (10). The body defines a chamber (15) and has a cover (14) enclosing the chamber (15). Two openings (150) are respectively defined in the opposite side wall of the chamber (15). A lever (20) is pivotally mounted in the upper end of the chamber (15) by pivots (21) respectively inserted through the openings(150). The lever (20) further forms a first stub (201) on the bottom of an end thereof. A linkage (30) which defines an aperture (31) in an upper end thereof is pivotally mounted on the bottom of an end of the lever (20) by a pin (22) being inserted through the aperture (31). The linkage (30) provides an insulated member (32) in a lower end thereof. The insulated member (32) is made up of bakelite and forms a inclined plane (320).

There is a step (not numbered) formed in the chamber (15) and a second stub (101) formed on the step. A spring (16) is disposed beside the linkage (30) and both ends of the spring respectively cover the stubs (101, 201).

Two terminals (11, 12) are spaced and mounted in the body (10). The lower ends of the terminals (11, 12) are extended out from the bottom of the body (10).

The first terminal (11) forms a sheet (110) on the upper end thereof. A bimetal (13) is fixedly and upstandingly attached on the sheet (110) of the terminal (11) and horizontally extended. The bimetal (13) is punched to form a protrusion (130) on the free end thereof. A first platinum node (131) is provided on the protrusion (130). An inclined side (132) is formed in the protrusion (130), clearly visible on FIG. 3.

The second terminal (12) is a reverse L-shape. An upright plate (120) is formed on the upper end of the terminal (12). A second platinum node (121) is provided on the upright plate (120) and opposite to the platinum node (131) of the bimetal (13). The two platinum nodes (121,131) are electrically connected with each other in a normal state.

Figure 2:
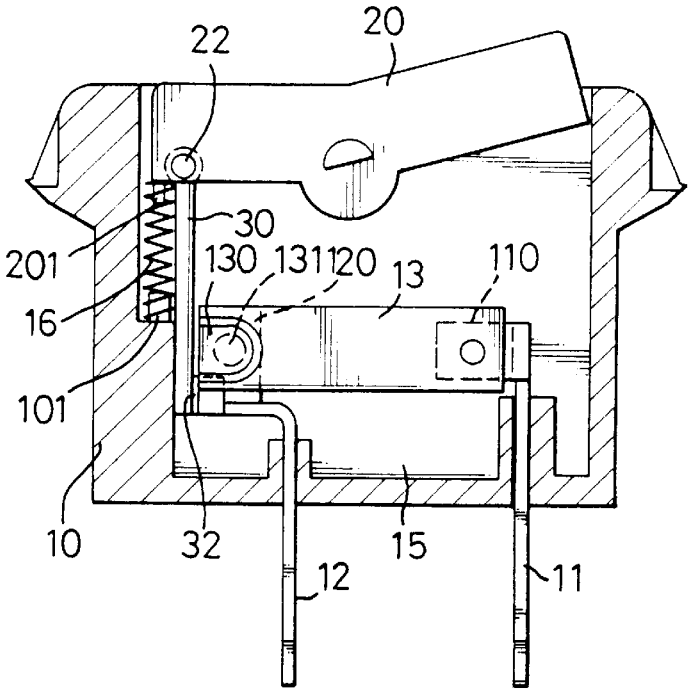
FIG. 2 is a sectional view of the circuit breaker according to the present invention.
Figure 3:
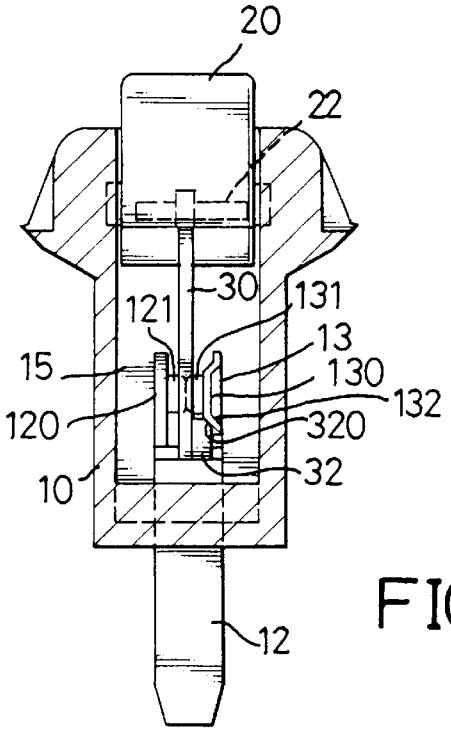
FIG. 3 is a side sectional view of the circuit breaker according to the present invention.
Figure 4:
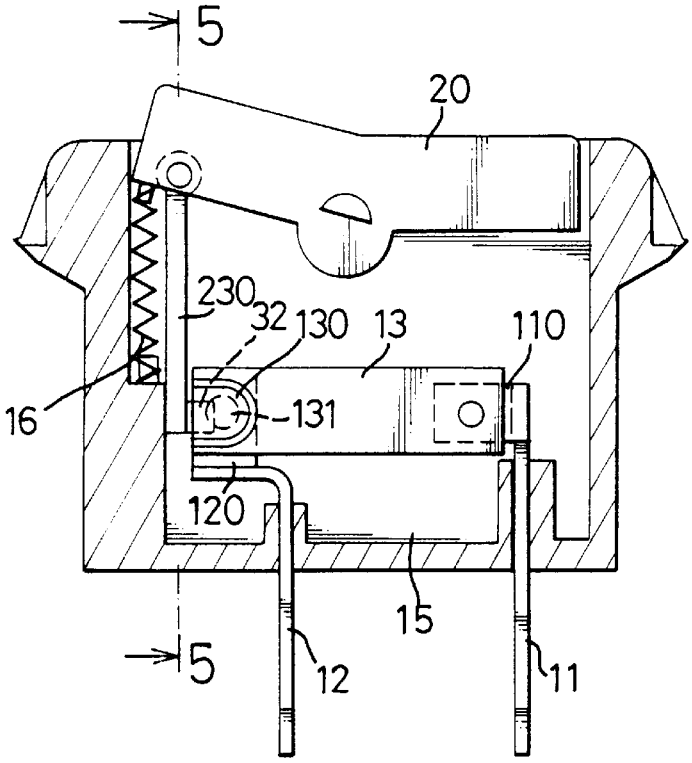
FIG. 4 is a sectional view of the circuit breaker showing a bimetal being disconnected from a second terminal.
Figure 5:
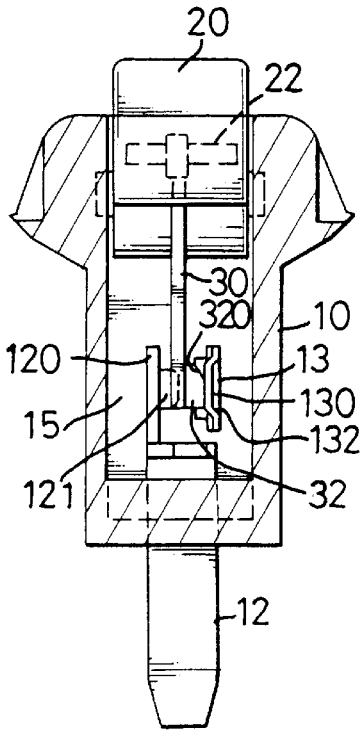
FIG. 5 is a side sectional view of the circuit breaker showing the bimetal being disconnected from the second terminal.
Figure 6:
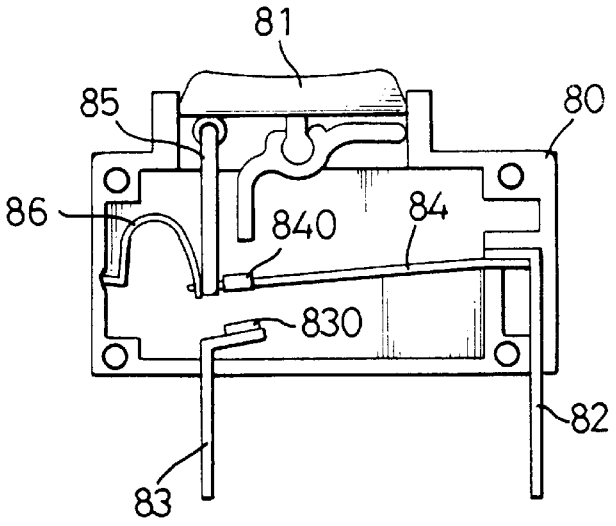
PRIOR ART FIG.6
FIG. 6 is a sectional view of a conventional circuit breaker.
Figure 7:
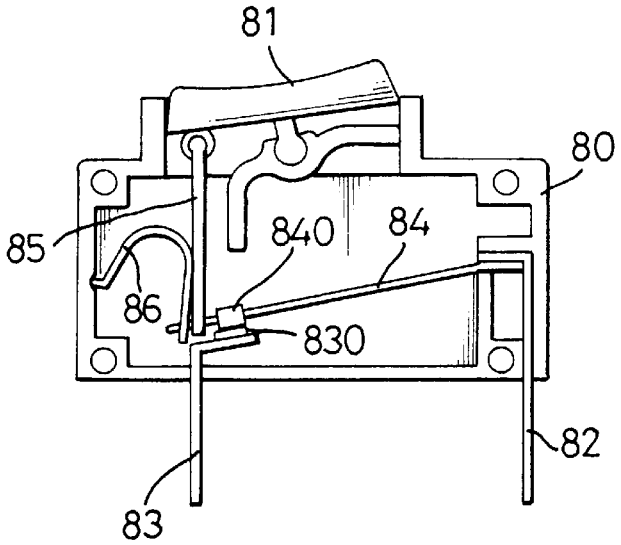
PRIOR ART FIG.7
FIG. 7 is a sectional view of the conventional circuit breaker.

As shown on FIGS. 2 and 3, the insulated member (32) of the linkage (30) is located between the free end of the bimetal (13) and the upright plate (120), and beneath the platinum nodes (121, 131). For cutting out the circuit, referring to FIGS. 4 and 5, a user presses the other end of the lever (20) to drive the linkage (30) upward, so the insulated member (32) gradually pushes the bimetal (13) along the inclined side (132). The first platinum node (131) of the bimetal (13) is separated from the second platinum node (121), thereby the circuit is cut out.

When the circuit is under over-current, the bimetal (13) will deform transversally as its temperature raised and will disconnect with the upright plate (120). This motion is not interfered by the lever (20) because the bimetal (13) is not connected with the lever (20). Therefore, the circuit can be effectively cut out under over-current, even if the lever (20) is held or blocked.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit breaker comprising:

a body defining a chamber therein and a cover enclosing the chamber, the chamber having two openings respectively defined in both side walls;

a lever pivotally mounted in the upper end of the body by pivots inserted through the openings;

two terminals mounted in the chamber and extended out from the bottom of the body, wherein the first terminal has a bimetal fixedly and upstandingly attached thereon and horizontally extended, the bimetal being electrically connected with the second terminal;

a linkage pivotally mounted in the bottom of the lever by pins inserting through an aperture defined in an upper end thereof, the linkage forming an insulated member in a lower end thereof, the insulated member being located between the first and second terminals;

by pressing the lever, the insulated member moves upward to separate the first and second terminals for cutting out the circuit.

2. The circuit breaker as claimed in claim 1, wherein the first terminal forms a sheet on an upper end thereof, the bimetal being fixedly and upstandingly attached on the sheet and forming a first platinum node on the free end; the second terminal is a reverse L-shape and forms an upright plate on an upper end thereof, the upright plate forming a second platinum node opposite the first platinum node, the two platinum nodes being electrically connected with each other.

3. The circuit breaker as claimed in claim 2, wherein the bimetal forms a protrusion on the free end and the first platinum node is formed on the protrusion.

4. The circuit breaker as claimed in claim 3, wherein the protrusion forms an inclined side.

5. The circuit breaker as claimed in claim 1, wherein the insulated member forms an inclined plane on the top thereof.

6. The circuit breaker as claimed in claim 1, wherein a spring is disposed beside the linkage and within the chamber, the spring standing up to the bottom of the lever.

* * * * *